United States Patent [19]

Pallanca

[11] Patent Number: 4,948,147

[45] Date of Patent: Aug. 14, 1990

[54] SOCCER TARGET

[76] Inventor: Michel Pallanca, 18 Boulevard de Cimiez Le Castel 1, 06000 Nice, France

[21] Appl. No.: 442,540

[22] Filed: Nov. 28, 1989

Related U.S. Application Data

[63] Continuation-in-part of Ser. No. 276,364, Nov. 23, 1988, abandoned.

[30] Foreign Application Priority Data

Nov. 24, 1987 [FR] France ..... 87 16540

[51] Int. Cl.[5] ..... A63B 63/00; F41J 1/10

[52] U.S. Cl. ..... 273/402; 273/26 A; 273/29 A; 273/396; 273/411

[58] Field of Search ..... 273/402, 395, 396, 411, 273/29 A, 1 B, 26 A

[56] References Cited

U.S. PATENT DOCUMENTS

| | | | |
|---|---|---|---|
| 2,873,969 | 2/1959 | Ziel | 273/402 X |
| 2,932,516 | 4/1960 | Penner | 273/402 |
| 3,427,026 | 2/1969 | Mahoney | 273/395 X |
| 3,583,703 | 6/1971 | Brown | 273/26 AX |
| 3,711,092 | 1/1973 | Hogue | 273/26 A |
| 3,856,298 | 12/1974 | Frantti | 273/402 X |
| 4,083,559 | 4/1978 | Owen, Jr. | 273/26 A |
| 4,173,337 | 11/1979 | Okonowski | 273/26 A |
| 4,210,326 | 7/1980 | Booth et al. | 273/402 X |
| 4,553,751 | 11/1985 | Ketchum | 273/395 X |
| 4,703,931 | 11/1987 | Steen | 273/411 X |

FOREIGN PATENT DOCUMENTS

| | | | |
|---|---|---|---|
| 929247 | 6/1963 | United Kingdom | 273/395 |

*Primary Examiner*—William H. Grieb

*Attorney, Agent, or Firm*—Frishauf, Holtz, Goodman & Woodward

[57] ABSTRACT

The present invention relates generally to training devices for playing various ball games and, more particularly, to a new target for making training easier for players in sports such as soccer and the like, in which a ball is kicked or otherwise shot toward a net.

8 Claims, 3 Drawing Sheets

SOCCER TARGET

This application is a continuation-in-part of allowed U.S. patent application Ser. No. 07/276,364, filed Nov. 23, 1988, now abandoned claiming priority of French application No. 87-16540 of Nov. 24, 1987.

The present invention relates generally to training devices for playing various ball games, and, more specifically, to a new target for making training easier for players in sports such as soccer and the like, in which a ball is kicked or otherwise shot toward a net.

For the sake of convenience, we will refer in the following text to soccer (sometimes referred to in Europe as "football"), but the invention can also be applied to any of several similar sports, for example: handball, grass polo, field hockey, ice hockey, and the like. The device of the present invention is essentially a training and perfecting means for players learning to shoot goals.

BACKGROUND

In the past, soccer players could perfect shots only with a real target, i.e. individually and with a goalie. This is costly and limits the practice possibilities for young players and/or those of slender means, and also for their clubs.

The practice target according to the present invention eliminates these disadvantages; it is easy to use and transport, and to adapt to an existing goal. It can also be self-contained, i.e. opened out and built in a playing area for utilization by several players.

THE INVENTION

This device of the invention includes essentially:

at least one target having in its external periphery fastening means for fastening it to a fixed frame, which can be the window of a conventional soccer goal, and at least a net attached to one of the extremities in the internal periphery of the aforesaid target.

As will be explained, the net itself has an essential role in the invention, providing recoil for the throwing back of bad shots. Consequently, it must be elastic, or fasten to the fixed frame by means having, or completing, elasticity.

In the case of a small-sized net, the preceding equipment can be sufficient for achieving both the aforementioned objects.

In the case of a large-sized net, maintaining sufficient tension is difficult with only one piece, and the combination according to the invention includes then a third element, which is:

a central frame, the width and height of which are adjustable, fastened at the upper part to the horizontal bar of the goal, and along the vertical sides at the other extremities of the aforesaid net. The most important function of this frame is to allow, by adjustment, the tensioning of the net. A secondary function in to make easier the passage of a player to the both sides of the net.

In an embodiment, the appliance according to the invention includes geometrical shaped targets, for example square or rectangular shaped, the size of which can be adjusted according to the wants of players. Targets are preferably hollow, constituting windows in which players try to shoot balls. They can be in one piece, vertical or divided in several tiers. A part of the periphery of a target can be made of a portion of the hanging frame.

According to another embodiment, interesting in particular when using the material in self contained utilization, i.e., without an existing goal, the targets can be full and equipped with electric sensors, the shots being then indicated by light or sound signals.

The fastening of targets on the window of an usual goal, or a self-contained frame, is made preferably with vertical hooks or crooks, provided if necessary with sleeves or elastomeric absorption pads, and with horizontal bands, helping simultaneously for solidity and suppleness of fastening.

In the case of an elastic net, it is made of one or several flexible horizontal bands, which can be maintained under tension because of the adjustable central frame as explained hereafter. Those bands are fastened at their horizontal ends to the vertical sides of the adjustable central frame, by mean of elastic elements, as springs, caoutchouc (rubber) tapes, such as "sandows", or equivalent. In the case of a net made of non-elastic strings, or already rigid, the fastening means become essential to assure the necessary elasticity.

Of course, in this embodiment, the smaller the surfaces of target are, the larger the surface of the central frame must be, so that the elastic bands are always tightened for throwing back balls.

On the contrary, the larger the targets are, the smaller the central surface can be, possibly up to its elimination so that the elastic bands are also always tightened for throwing back the balls; the aforesaid net plays the role of goalie.

Lastly, the central frame, when it exists, is preferably made of both halves, each adjustable in height and one fitting in the other, horizontally, so that it can also be adjustable in width, as it is said previously.

Concerning a previous embodiment, the appliance according to the invention comprises then this central frame, to which are fastened the extensible nets for threading back balls and the targets, the whole being then likely to be spread out, to be adapted to an existing goal, the net of which allowing the recovery of balls.

According to a second embodiment, the same appliance can be fixed to a transportable frame, for an independent utilization, which does not require the use of a goal. In this case, it can be advantageous to tie down the vertical bars of the central frame. However, the additional frame can be used for fasten the frame to the goal.

BRIEF FIGURE DESCRIPTION

The invention will be now described, referring to the accompanying drawings, wherein:

FIG. 1 is a front view of a first embodiment of an appliance according to the invention, without additional frame, fastened to an existing goal:

FIG. 1*a* and 1*b* are similar half-views, the making of the targets being quite different because only a part of their peripheries are materialized, FIG. 2 is a cross-sectional view of frame 30 of the same appliance, but having an additional frame;

FIG. 3 presents the constitution of an adjustable target, and FIG. 4 presents a multiple non-adjustable target.

DETAILED DESCRIPTION

Figure 1:
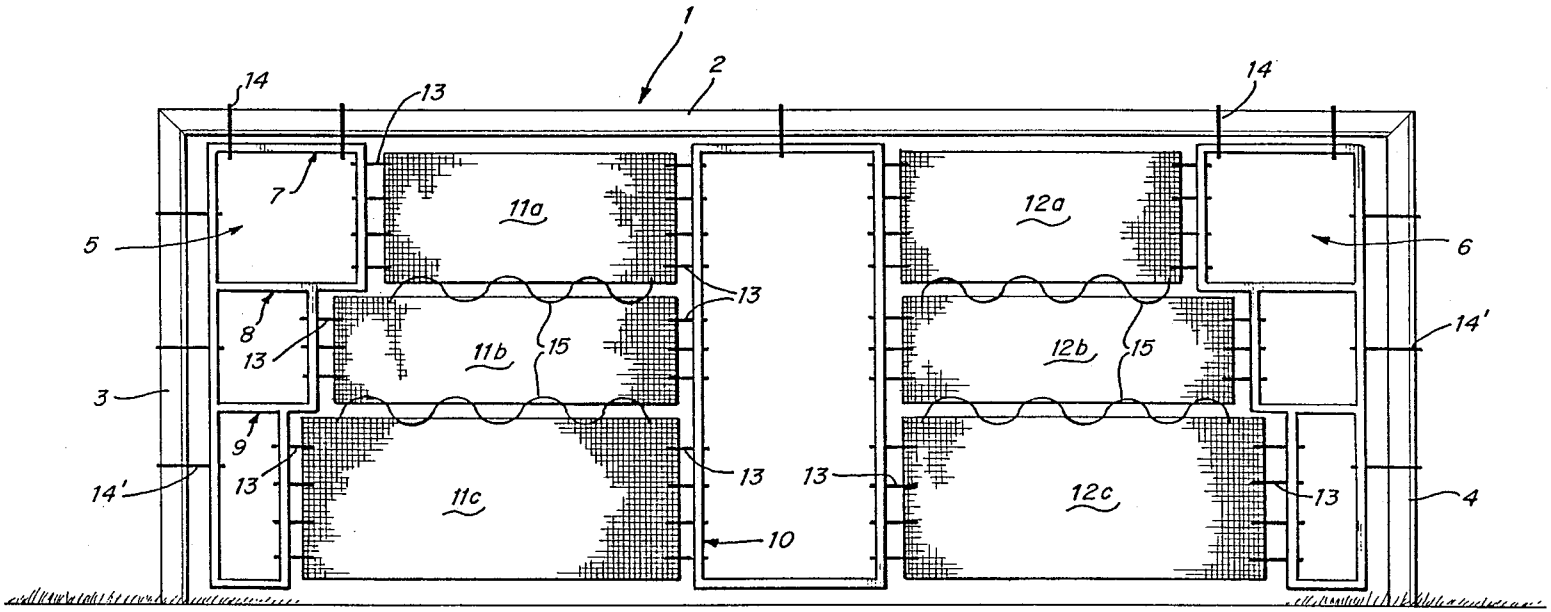
Figure 4:
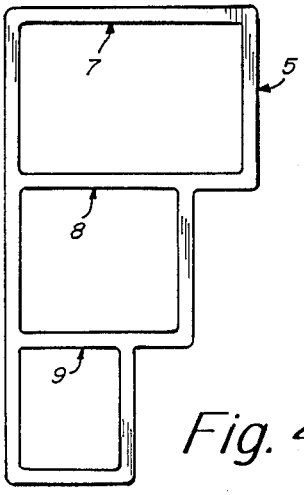

Referring first to FIG. 1 and the first embodiment, the appliance comprises on one hand a symmetrical couple of lateral target 5 and 6, which, in the presented case, each include a whole of three superposed targets, 7-8-9, as shown on FIG. 4.

These targets are made of aluminum or steel pipes or equivalent; it is also possible to use plastic; on the other hand, an adjustable central rectangle 10, for hanging a first end of elastic horizontal bands 11*a*, 11*b*, 11*c* and 12*a*, 12*b*, 12*c*, the other ends of the same bands being hung to the internal vertical sides of the targets 5 and 6. The bands 11 and 12 can be in one piece and cut out according to the shape of the targets.

The hanging can be made, on each side of the bands 11 and 12, on the targets and the central frame, by mean of hooks 13 preferably elastic. Targets 5 and 6 are also equipped over its external periphery with hooks 14 and 14,, intended for the fastening of an appliance over the sides, horizontal 2, and vertical 3 and 4, of a goal 1.

Detachable strings 15 are used to bind the horizontal bands 11 and 12.

Figure 2:
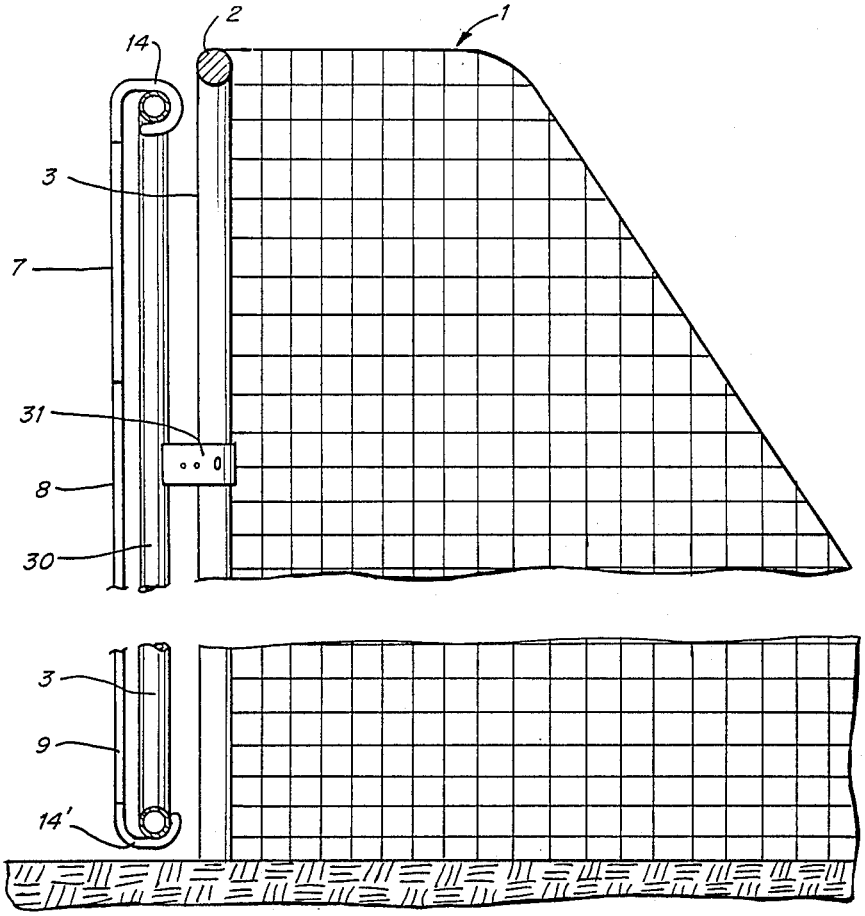

In the cross-sectional view of FIG. 2, targets 7-8-9 are hung by hooks 14,14', not directly over sides 2 and 3 of the goal 1, but to an additional frame 30, attached by bands 31 to the goalposts 3.

Figure 3:
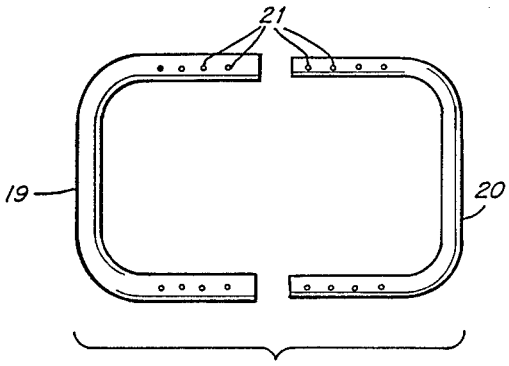

To allow a more improved use of the system, targets 5 and 6 can be adjustable, for example in width, FIG. 3 shows a target such as 7, adjustable in width. For the purpose, it comprises both half-frames of pipes 19–20, sliding the one in the other, and which can be locked in one or another position by pins crossing over corresponding holes 21 of the half frames. The elasticity of the bands of the net 11 and 12 make sure that in any adjustment, a ball which does not well aim the target will be thrown back to the playing area.

In the same way, the elements of the central frame 10 are adjustable in width, allowing the tensioning of the whole system. They can also be adjustable in height, particularly in the case when the lower extremities of vertical bars of the frame must be drove in the soil.

To assure simultaneously the solidity of the fastening by hooks 14 and the dampening of ball-shocks over the sides, the aforesaid hooks 14 can be tightened by means of bands, and the aforesaid hooks as well as the aforesaid sides can be equipped with dampening element of elastomeric material.

Figure 1B:
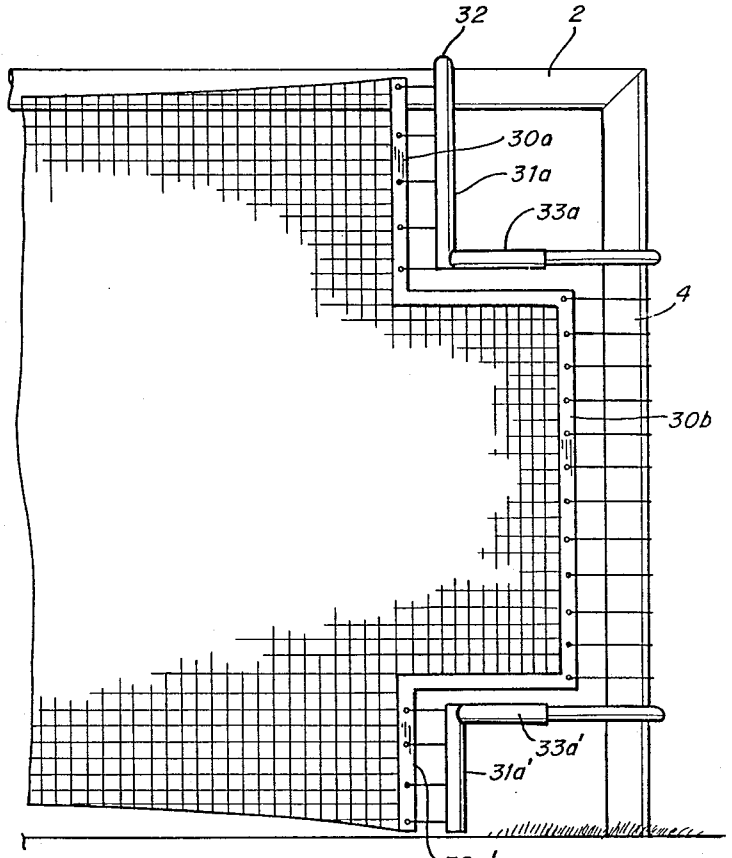
Figure 1A:
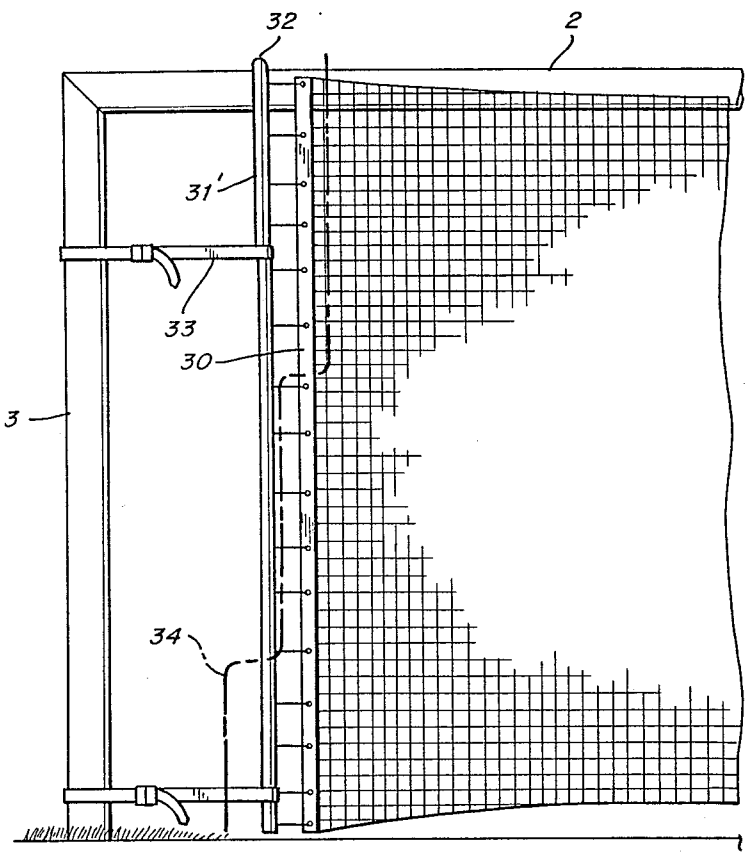

Lastly, FIG. 1*a* and 1*b* illustrate how a portion of the periphery of targets can be made of the hanging frame itself.

Referring to FIG. 1*a*, the small net is delimited along the left vertical side 30 by a vertical tubular bar 31', attached to the horizontal bar 2 by a crook 32 and to the vertical goalpost 3 by adjustable bands 33.

In this case, the target is defined by the rectangle 2-3-31-ground. This materialization can furthermore be modified to another shape, illustrated by the broken line 34 of the tubular bar 31.

Referring to FIG. 1*b*, the right vertical side of the net includes two areas 30*a* and 30*a'*, hung to tubular bars 31*a* and 31*a'*, and area 30*b* hung directly to the vertical goalpost 4. The bar 31*a* is attached by a crook 32 to the bar 2. The bar 31*a'* stops over the ground like the bar 31*a*.

At the opposite extremities, vertical bars 31*a* and 31*a'* are fixed to hanging crooks 33*a* and 33*a'*, the length of which is adjustable, playing the same role as bands 33.

In this embodiment, targets are then materialized respectively by the rectangle 2-4-33*a*-31*a* and by the rectangle 31*a'*-33*a'*-4-ground.

It will be considered that, in the both previous embodiments, the upper part of the net is located before the horizontal bar 2 of the goal. It is the same for the embodiment of FIG. 1.

In the case of a self-contained material, the whole system is directly hung to a frame similar to 30, preferably adjustable, having the same size as the goal 1, which must be drove in the ground by all appropriate means.

Of course, the previous description is illustrative and not limitative, and it is possible to find other embodiments for the invention particularly when applying the appliance to any other defined games, for which the invention facilitates training. For example, the same appliance used in hockey can include targets placed just over the ground.

I claim:

1. Target and ball return means for training of players practicing a sport involving shooting a ball toward a goal having a pair of uprights (3,4) and a horizontal crossbar (2) supported by said uprights (3,4), comprising:

a dimensionally adjustable central frame (10);

at least one dimensionally adjustable target (5,6,7,8,9);

at least one net (11, 12) for causing rebound of any incident ball which misses said at least one target;

means (14) for suspending at least said central frame (10) and said at least one target, side-by-side, by respective peripheral edges of each from said horizontal crossbar (2) and for attaching at least one of said target and said net along a peripheral edge thereof to one of said uprights (3,4); and means (13) for fastening adjacent peripheral edges of said central frame (10), net (11,12) and target to each other, thereby covering substantially all of an opening defined below said horizontal crossbar and between said goal uprights (3,4).

2. Target and ball return means according to claim 1, wherein said target and said central frame each comprise at least two parts (19,20), one of which (20) is telescopically slidable within the other (19), and further comprising means (21) for securing said parts in any selected one of a plurality of dimensionally adjusted positions.

3. Target and ball return means according to claim 2, wherein, the material of the net is only a slightly elastic, elasticity being provided by the peripheral fastening means of the net.

4. Target and ball return means according to claim 1, wherein;

a plurality of said nets are provided, one above the other, and further comprising means (15) for interconnecting respective peripheral edges of said nets.

5. Target and ball return means according to claim 4, wherein, the material of the net is only slightly elastic, elasticity being provided by the peripheral fastening means of the net.

6. Target and ball return means according to claim 1, wherein, the material of the net is only slightly elastic, elasticity being provided by the peripheral fastening means of the net.

7. Target and ball return means for training of players practicing a sport involving shooting a ball toward a goal having a pair of uprights (3,4) and a horizontal crossbar (2) supported by said uprights (3,4), comprising:

a generally rectangular portable frame (30) adapted for attachment (31) to said goal (2,3,4);

a dimensionally adjustable central frame (10);

at least one net (11, 12) of elastic material for causing rebound of an incident ball;

at least one dimensionally adjustable target (5,6,7,8,9);

means (14) for suspending at least said central frame (10) and said at least one target, side-by-side, by respective peripheral edges of each from said portable frame (30) and for attaching at least one of said target and said net along a peripheral edge thereof to said portable frame (30); and means (13) for fastening adjacent peripheral edges of said central frame (10), net (11,12) and target to each other, thereby covering substantially all of an opening defined by generally rectangular portable frame (30).

8. Target and ball return means according to claim 7, further comprising means for supporting said portable frame in a vertical orientation with respect to adjacent ground, independently of any goal.

* * * * *